United States Patent [19]

Zundel

[11] 4,149,479

[45] Apr. 17, 1979

[54] METHOD FOR FORMING OPENING MEANS IN PANEL

[75] Inventor: Arthur P. Zundel, Mt. Prospect, Ill.

[73] Assignee: National Can Corporation, Chicago, Ill.

[21] Appl. No.: 873,549

[22] Filed: Jan. 30, 1978

Related U.S. Application Data

[62] Division of Ser. No. 789,096, Apr. 20, 1977, abandoned.

[51] Int. Cl.[2] ..... B21D 51/44

[52] U.S. Cl. ..... 113/121 C; 113/15 A

[58] Field of Search ..... 113/15 R, 15 A, 121 C; 220/269, 273, 268

[56] References Cited

U.S. PATENT DOCUMENTS

| | | | |
|---|---|---|---|
| 3,428,210 | 2/1969 | Brown | 220/270 |
| 3,820,681 | 6/1974 | Hulse | 113/15 |
| 3,871,314 | 3/1975 | Stargell | 113/121 C |
| 3,912,113 | 10/1975 | Peyser | 220/269 |
| 3,912,114 | 10/1975 | Morran et al. | 220/268 |
| 4,036,159 | 7/1977 | Gane et al. | 113/121 C |

*Primary Examiner*—Michael J. Keenan

*Attorney, Agent, or Firm*—Robert A. Stenzel; Ralph R. Rath

[57] ABSTRACT

A method of forming a removable section in a metal wall portion of a container is disclosed herein. A first, area of reduced cross-section is coined the wall portion outside the first coined area and most of the displaced metal is forced inside the first area so that the portion inside the first area is in compression and is substantially dish-shaped in cross section, a weakened line is then produced in the first area to define a removable section.

6 Claims, 13 Drawing Figures

METHOD FOR FORMING OPENING MEANS IN PANEL

REFERENCE TO RELATED APPLICATION

This application is a division of application Ser. No. 789,096 filed Apr. 20, 1977, now abandoned.

BACKGROUND OF THE INVENTION

For many years, can manufacturers have been producing cans having the familiar ring-pull and removable section which could be completely severed from the remainder of the container. Examples of end panels of containers having this type of removable section are disclosed in U.S. Pat. No. 3,445,029 and 3,428,210.

Since the container industry produces at least 46 billion cans annually for packaging soft drink and beer, millions of these tear strips and tabs are left on beaches, parks, along highways and in campgrounds each year and these are not only unattractive but area also considered dangerous.

Thus, for nearly a decade, the can industry has attempted to develop non-detachable substitutes for the familiar pull-tab cans. One type of substitute that has been proposed is known as the "button" design wherein a weakened area is defined in the end panel of the container and the entire button is severed from the end panel and drops into the container. Examples of this type of substitute are shown in U.S. Pat. Nos. 3,902,626; 3,902,627; and 3,982,657. The main problem with this type of design is that considerable pressure must be exerted to sever the weakened line when a pressurized carbonated beverage is packaged in the container. This type of container is also considered in some respects to be unsanitary since the "button" drops into the contents. One type of design which has been proposed in this category includes two openings in the end panel of different size, one providing a venting feature and the second for a pouring opening. This arrangement creates an additional problem in that the smaller "button" may come out of the larger hole with the contents. A further problem encountered with this type of closure or end panel is that the user may cut his finger during severing of the "button."

As a further alternative to the well known ring-pull tab, various other types of end panels have been proposed wherein a tab type unit is utilized for fracturing a weakened line and the tab is then used in supporting the severed portion on the container panel. This type of arrangement is disclosed in U.S. Pat. No. 3,236,409.

Other types of end closures have been proposed wherein the severed portion remains permanently attached at at least a localized area after fracture of the weakened area. Examples of this type of unit are disclosed in U.S. Pat. Nos. 3,946,683; 3,934,750; and 3,874,555.

While there have been literally dozens of proposed substitutes for the familiar severable tear strip with the attached tab, none of the proposed substitutes has received any substantial degree of commercial success because they are either too complicated to operate, too expensive to produce or are unsanitary during use. Thus, there remains a need for a non-detachable opening device which is capable of withstanding a required pressure without leaking, and also is capable of meeting the minimum pressure requirements with respect to "buckling" and "rock."

SUMMARY OF THE INVENTION

According to the present invention, a removable section is formed in a wall portion of a container by initially coining a peripheral inner closed area to a reduced thickness and then coining an outer close area spaced from and surrounding the inner closed area. The inner closed area is then scored to produce a residual that defines the removable section.

According to one aspect of the invention, the residual between the removable section and the remainder of the wall portion has a substantially constant thickness along a major portion of the length thereof and also has at least one minor portion of less thickness than the major thickness. Thus, when a force is applied to the removable section, the residual will initially sever at the minor portion of lesser thickness to provide a vent for relieving pressure from inside the container and subsequently sever the remainder of the residual to completely separate the removable section from the remainder of the wall portion.

The removable section also has removal means in the form of a tab having a peripheral size larger than the size of the opening in the wall portion formed by severing the residual and has severing means which initially sever the residual of lesser thickness and then subsequently sever the remaining portion of the residual.

According to another aspect of the invention, the wall portion surrounding the removable section is reinforced by at least a pair of strengthening beads that are deformed in the metal and extend generally parallel to each other outside the area of the removable section.

According to the method aspect of the present invention, a flat wall portion of substantially constant thickness is first coined to produce a substantially annular inner enclosed area of reduced thickness in at least one surface of the wall portion in a manner to flow the displaced metal into the circular area so that the portion inside the coined area is substantially concave in cross section and the metal is in compression. The metal wall portion is then coined outside the annular inner closed area of reduced thickness to displace additional metal into the removable section and place the metal further in compression. Thereafter, the inner coined area of reduced thickness is scored to produce a residual at the base of the score defining the removable section.

After the scoring tool is removed, it has been determined that the compressed metal in the removable section will expand and the flow of metal can be controlled to produce a locking feature between the removable section and the remaining wall portion of the container. Upon severing of the residual, the removable section will expand slightly thereby preventing removal of the removable section from the container.

DETAILED DESCRIPTION

Figure 1:
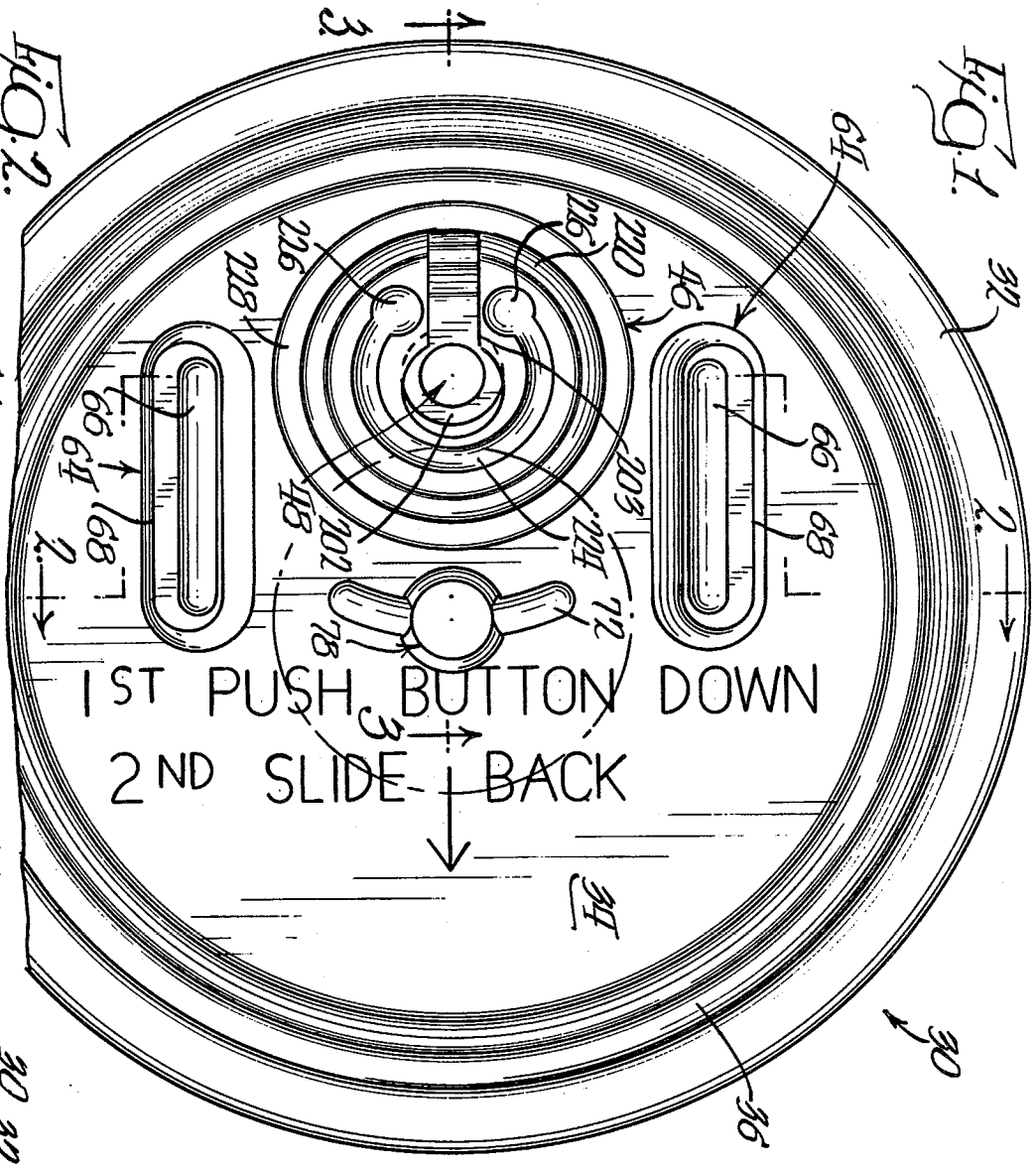
FIG. 1 shows a plan view of a container end having the present invention incorporated therein.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 of the drawing shows a wall portion of a container such as an ecology end panel generally designated by reference numeral 30. Ecology end panel 30 has a peripheral curl 32 adapted to be seamed to a container body (not shown), a central generally flat portion 34 and a countersink wall portion 36 joining flat portion 34 to peripheral curl 32.

Figure 3:
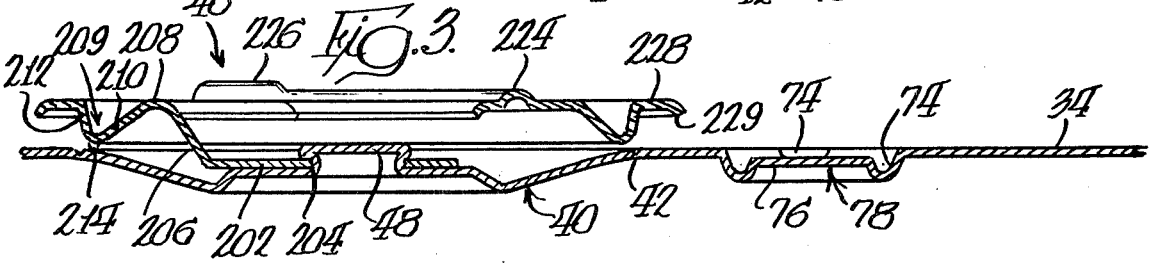
FIG. 3 is an enlarged fragmentary sectional view, as viewed along line 3—3 of FIG. 1.
Figure 4:
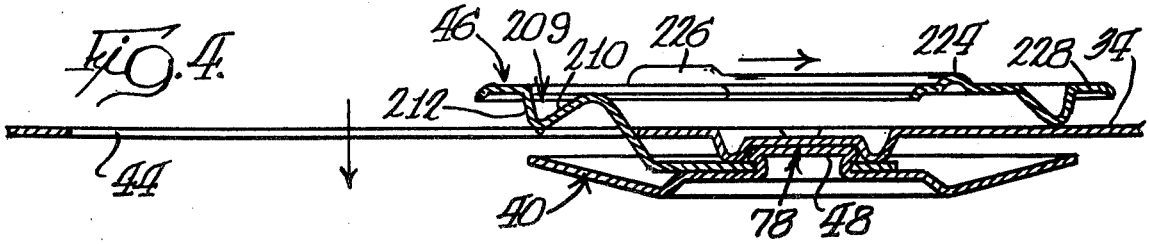
FIG. 4 is a sectional view similar to FIG. 3 showing the container end in an open position.

According to the present invention, central flat portion 34 has a removable section defined therein that is capable of being completely severed from the wall portion and is capable of being operatively retained on the wall portion while the opening created therein defines a means for removal of the contents. As shown in FIG. 3, removable section 40 is defined by a circular weakened line 42 that, when severed, will produce a circular opening 44, as illustrated in FIG. 4. Removable section 40 has removal or opening means 46 secured thereto through a rivet 48, as will be explained in more detail later.

According to one aspect of the invention, the weakened area is formed in a unique fashion to insure that the removable section can readily be completely severed from wall portion 34 with a minimum amount of force being applied thereto. However, before being severed, the container end 30 is capable of withstanding at least 90 PSI pressure within the container without causing the panel to "buckle" or "rock."

Figure 5:
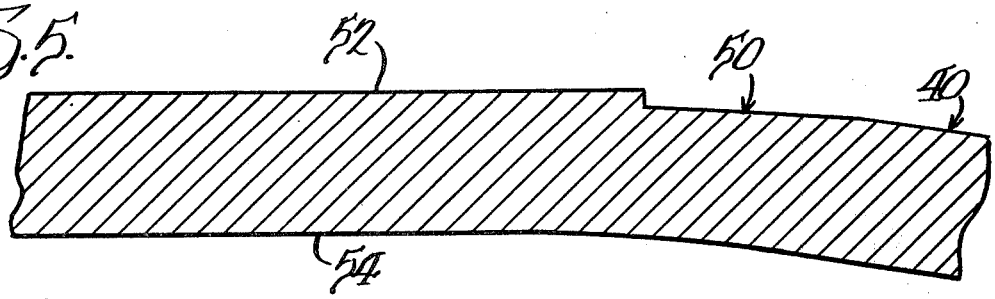
FIG. 5 is an enlarged fragmentary sectional view after the first step in forming the removable section.
Figure 6:
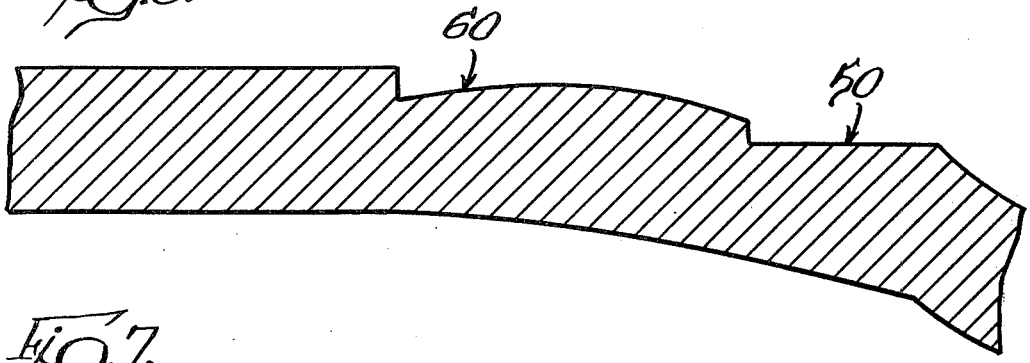
FIG. 6 is a view similar to FIG. 5 showing the panel after the second step in forming the removable section.
Figure 7:
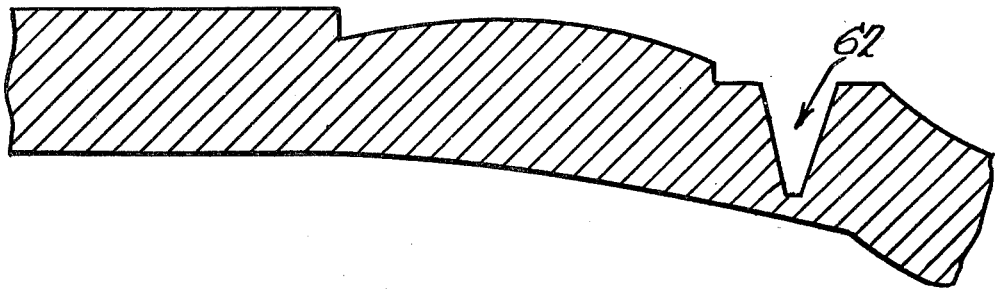
FIG. 7 is a view similar to FIG. 5 showing the final configuration of the weakened line.

As shown in FIGS. 5, 6 and 7, weakened line 42 is produced in a three-step process which has several distinct advantages, as will become apparent hereinafter. The first step in forming weakened line 42 is illustrated in FIG. 5 and consists of coining a substantially circular area to produce a flat annular reduced portion 50 on one surface, the outer public surface, of wall portion 34. During the formation of the first flat annular reduced portion 50, the metal which is displaced in the coining operation flows into removable section 40 and results in placing the metal in the removable section in compression and also causes the removable section or disc 40 to become concave in cross-sectional or dish-shaped.

In has been found that the amount of coining or reduction in wall thickness in the weakened area during the initial step will determine the amount of dishing effect that will occur in the removable section. The coining operations will result in work hardening of the metal in the annular area 50, which may be considered as making the material in the annular area 50 more brittle when compared with the remainder of the wall portion 34.

The next step in forming the removable section is to produce a second flat annular reduced portion or coin 60 surrounding and slightly spaced from the inner or first annular reduced portion 50. The metal that is displaced during coining of the second or outer flat annular reduced portion 60 again flows into the area inside reduced portion 60 and places the metal in the circular disc 40 further under compression, for a purpose that will be described later. During the formation of this outer flat annular reduced portion or outer coin 60, the area between inner and outer coins 50 and 60 is also reshaped so that the area between the two coins is inclined slightly with respect to panel portion 34. This feature is of significance as will be explained in more detail later.

The last step in forming the removable section 40 consists of producing a score 62 within the inner coin or first flat annular reduced portion 50, and score 62 defines the removable section or disc 40.

The final configuration of the weakened area is illustrated in an enlarged fragmentary view in FIG. 12 and the important advantages of deforming weakened line 42 in a three-step process will be described later.

Figure 2:
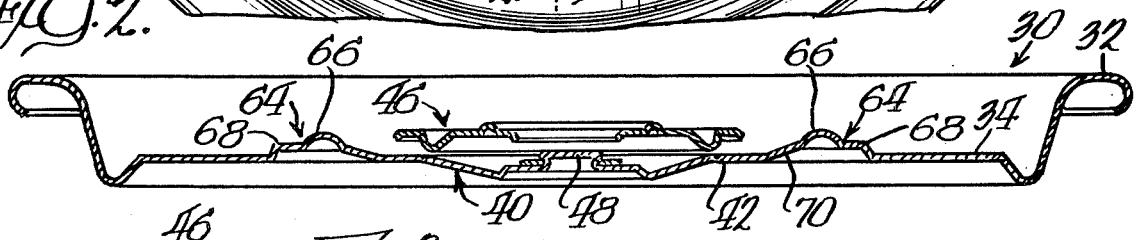
FIG. 2 is a sectional view, as viewed along line 2—2 of FIG. 1.

Panel portion 34 also has reinforcing means substantially surrounding the entire removable section to insure that the panel portion 34 outside of weakened area 42 is sufficiently rigid to prevent deflection during the opening process. As more clearly shown in FIGS. 1 and 2, the reinforcing means includes a pair of reinforcing members 64 which extend parallel to each other and are located on opposite sides of removable section 40. Each reinforcing member 64 has an end portion extending beyond the center of the removable section (defined by rivet 48) so that a plane extending through the center of rivet 48 and perpendicular to reinforcing members 64 will intercept an end portion thereof.

Each reinforcing member 64 consists of an elongated primary element or bead 66 deformed from the body or wall portion 34 and a secondary element or bead 68 which surrounds primary element or bead 66. As more clearly illustrated in FIG. 2, secondary element or bead 68 has a flat inclined inner wall portion 70 located adjacent and in close proximity to weakened line 42 and it has been found that this flat inclined wall increases the rigidity of the panel adjacent opposite sides of removable section 40. This flat inclined wall portion 70 is believed to be beneficial in preventing premature rupture of the adjacent weakened line 42.

Reinforcing members 64 not only provide rigidity to panel portion 34, but also extend away from panel portion 34 a sufficient distance to have upper edges located above the upper surface of tab 46 and protect opening means or tab 46 during subsequent operations, shipment and storage after the end has been completed.

The reinforcing means also include an arcuate bead 72 that is deformed inwardly and surrounds removable section 40 at a location diametrically opposed to the periphery of panel end 30. As more clearly shown in FIGS. 1 and 3, arcuate reinforcing means 72 also has a circular depressed portion 74 and circular depressed portion 74 has a center portion 76 deformed upwardly to define a recess 78, for a purpose that will be described later.

Figure 8:
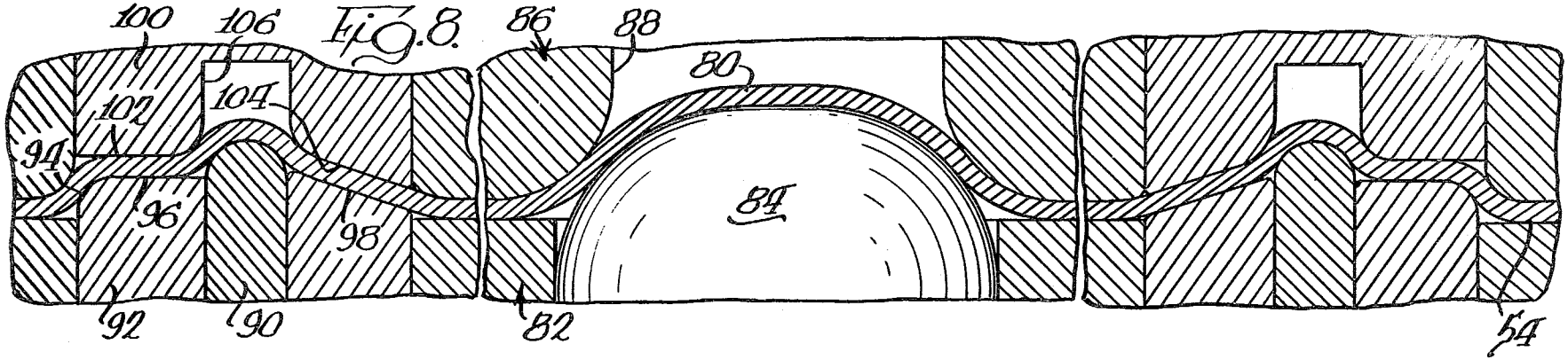
FIG. 8 is an enlarged fragmentary sectional view showing the tooling for the first step in forming the end panel.

Before considering the construction of the opening means of tab 46, the various operations for deforming a flat panel to a finished end will be described. The first step of converting a flat panel or blank to finished end is illustrated in FIG. 8. In this operation, an initial blister 80 and reinforcing members 64 are formed utilizing cooperating die elements.

Considering first the formation of blister 80, which is positioned so that it will be located in the center of removable section 40, a lower die element 82, having a substantially spherical upwardly directed projection 84, is positioned adjacent lower surface 54 of panel portion 34 while an upper die element 86, having a substantially circular opening 88, is positioned adjacent upper surface 52 of panel portion 34. Thus, relative movement of die elements 82 and 86 towards each other will deform the flat panel and produce blister 80.

Simultaneous to the formation of blister 80, reinforcing members 64 are also formed in panel 34. For this purpose, lower die element 82 has an elongated member 90, which has an arcuate upper surface and is surrounded by a die element 92 having an arcuate surface 94 merging with a flat surface 96 on one side thereof while the opposite side has a flat inclined upper surface 98. Upper die element 86 has a member 100, which has a lower flat outer surface 102 that cooperates with flat surface 96, and an inclined surface 104 complimentary with surface 98 on the inner side thereof with a recess 106 between the two surfaces. Thus, relative movement of die members 82 and 86 will simultaneously produce blister 80 and both reinforcing members 64.

Figure 9:
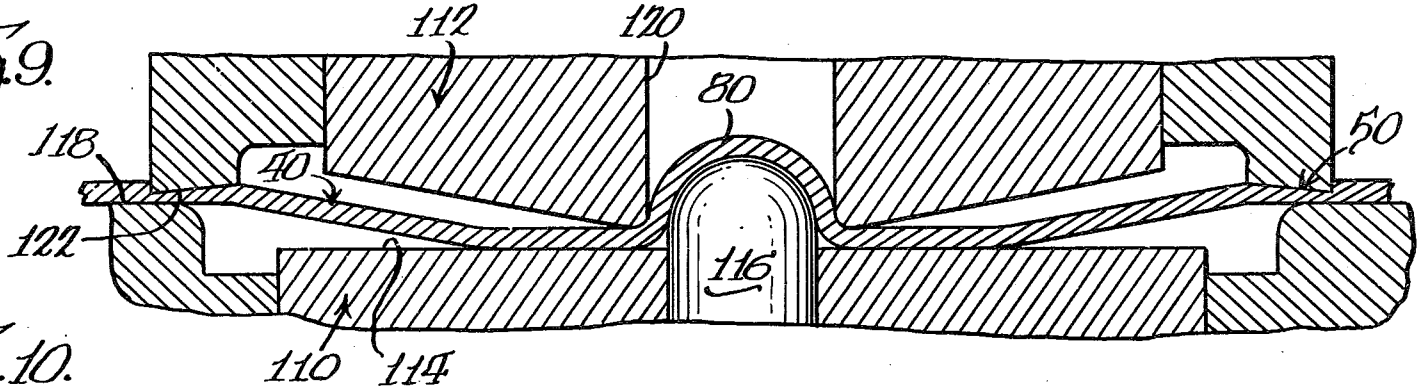
FIG. 9 is a sectional view showing the tooling for the second step in the formation of the end panel.

The next step in the conversion of a blank to a finished panel is the formation of inner coin 50 that is illustrated in FIG. 3 and deforming blister 80 to its final configuration before tab 46 is secured thereto, as will be described later. As shown in FIG. 9, inner coin or first flat annular reduced portion 50 and reformation of blister 80 are performed using a lower die element or member 110 and an upper die element or member 112. Lower die member 110 has a flat circular upper surface 114 in the center portion thereof with a spherical member 116 projecting above surface 114 at the center thereof. Lower die member 110 also has a flat peripheral annular surface 118 surrounding surface 114 and located at a higher level.

Upper die element or punch 112 has a center recess 120 aligned with spherical member 116 and a flat lower peripheral surface 122 which is preferably inclined and defines an angle of less than 5 degrees and preferably approximately one degree with respect to the planar horizontal surface 118 on the lower die element 110. Thus, movement of die members 110 and 112 towards each other will reshape blister 80 to the configuration illustrated in FIG. 9 and simultaneously produce the inner or first coin 50. It should be noted that utilizing a flat annular surface 122, which is slightly inclined, for coining a circular area of reduced thickness 50 insures that the metal which is displaced from the flat annular reduced portion 50 flows inwardly into removable section 40 and results in the removable section being transformed from a substantially flat portion to a dish-shaped or substantially concave configuration in cross section. To maintain an accurate control of the removable section 40, the center portion of removable section or disc 40 is flattened, as illustrated in FIG. 9, by flat surface 114. At the same time, because of the flow of the metal that is displaced, the metal in the removable section is placed under compression.

Figure 10:
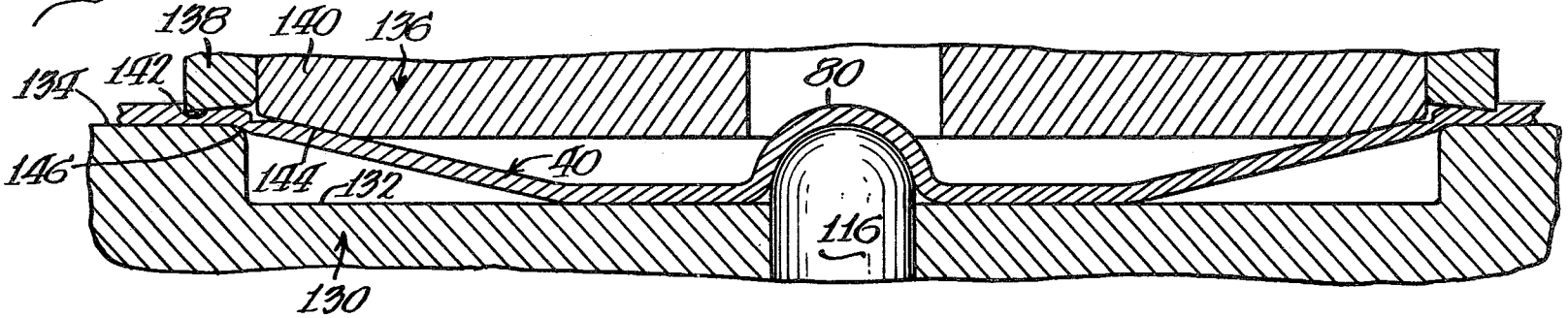
FIG. 10 is a sectional view showing the tooling for the third step of forming the end panel.

The next step in converting panel portion 34 consists of forming the outer coin or second annular portion 60. Simultaneous to the formation of outer coin 60, it has been found desirable to reshape the area between inner and outer coins 50 and 60. These steps are accomplished by utilizing tooling illustrated in FIG. 10. As shown in FIG. 10, a lower die element 130 has a center flat surface 132 with a spherical member 116 identical to the one utilized in the previous step aligned with the reformed blister 80. A second annular flat surface 134 surrounds the surface 132 and is spaced above surface 132.

Upper die member 136 has an outer annular punch 138 and a center portion 140. Outer annular punch 138 again has an inclined surface 142 which is inclined less than 5 degrees, preferably approximately one degree, with respect to flat surface 134 so that relative movement of the die members toward each other will produce the outer coin 60. During the production of outer coin 60, the displaced metal again flows inwardly into removable section 40 to place the metal therein under further compression.

The reshaping or reforming of the area between inner and outer coins 50 and 60 is accomplished with an annular inclined surface 144 which cooperates with a radiused portion 146 on the inner edge of flat surface 134. Thus, the relative position of the two surfaces with respect to each other will determine the angle of inclination or "drape angle" (A, FIG. 12) that is developed between the inner and outer coins. This "drape angle" (A) has been found to be important in the formation of a satisfactory end that can be opened with a minimum amount of force. While the importance of the "drape angle" is not fully understood, it is believed that introducing the "drape angle" into the area between the two coins will result in having inner coined area 50 located below outer coined area 60, which is believed to be advantageous, for reasons that will be described below.

Figure 11:
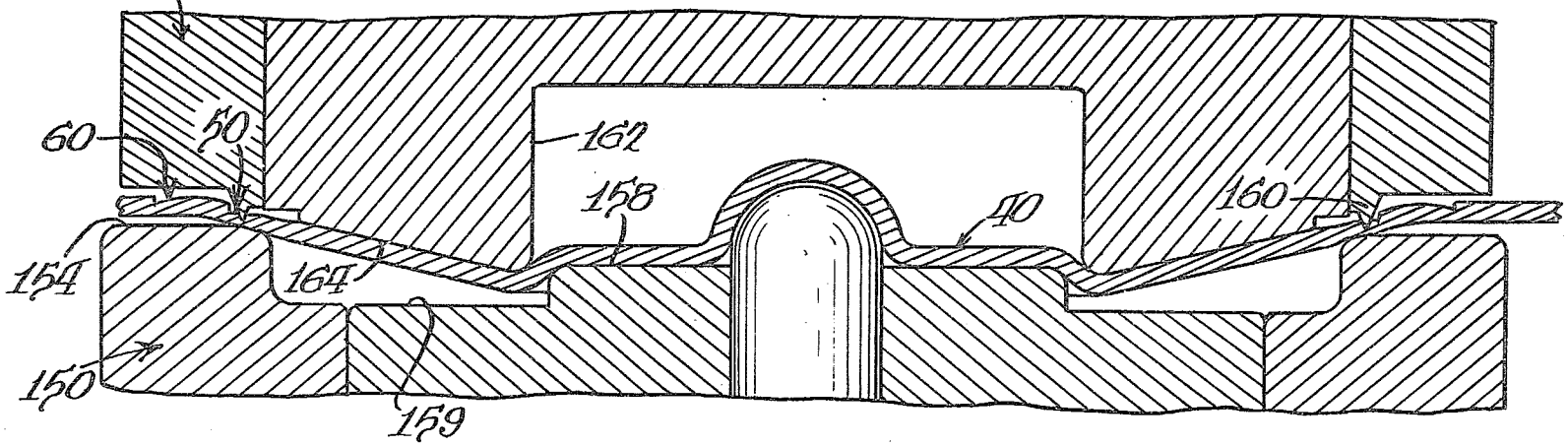
FIG. 11 is a sectional view showing the tooling for the final step of deforming the panel.

The next operation consists of forming the score line 62 to define the final finished removable section. This is accomplished with die elements as illustrated in FIG. 11. During the formation of score line 62, it is also desirable to simultaneously reform the center of the disc, as will now be explained.

Figure 11A:
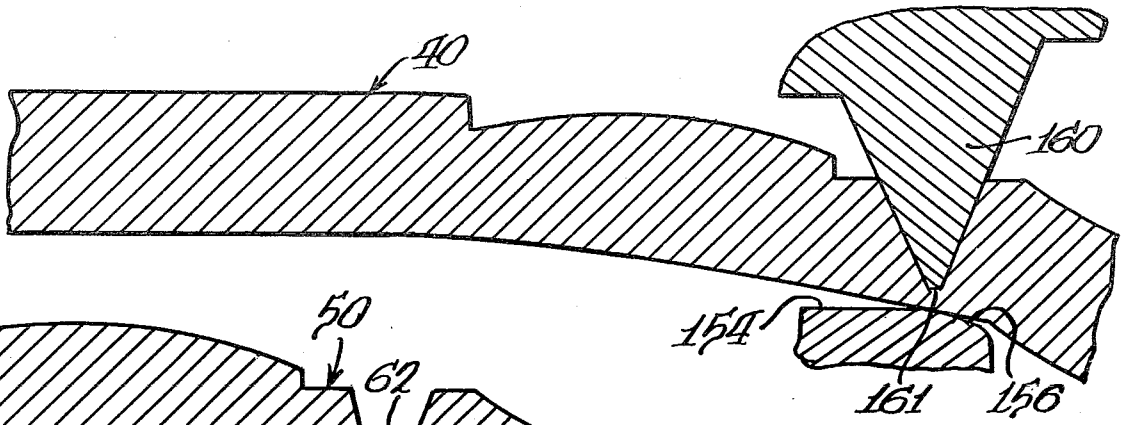
FIG. 11*a* is an enlarged fragmentary view showing details of the scoring tool.

The score line 62 is formed with lower and upper die members 150 and 152 with lower die member 150 having a flat outer annular surface 154 which has a flat inclined inner edge or surface 156 (FIG. 11*a*). Inner surface 156 is preferably inclined approximately forty-five degrees with respect to outer annular surface 154. Lower die element also has one or more raised portions (not shown) extending above surface 154 and each raised portion circumscribes a small arc, as will be explained later. The center portion of lower die 150 has an elevated surface 158 located below surface 154 and the area between the surface is recessed at 159.

Upper die member 152 has a scoring punch 160 formed on the periphery thereof and punch 160 is substantially V-shaped in cross section. The lower edge of V-shaped punch 160 has a small flat portion 161 which is aligned with flat surface portion 154 and also is aligned with the raised portions. Upper die member 152 also has a center recessed portion 162 that is aligned with circular flat surface 158 and an inclined surface 164 surrounding recess 162. Thus, when die members 150 and 152 are moved towards each other, surfaces 158 and 164 will cooperate to raise the center portion of removable section to the position illustrated in FIG. 11.

Figure 13:
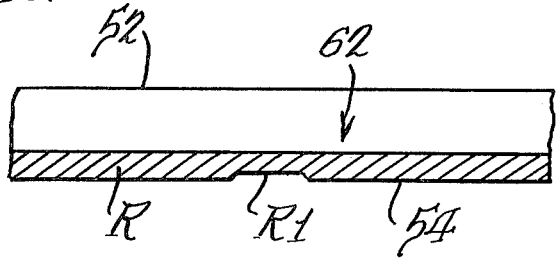
FIG. 13 is a fragmentary developed view of the weakened area showing the residual having different thicknesses.

During this relative movement, punch 160 produces a V-shaped score 62 in the inner coined area 50 and the metal that is displaced by the V-shaped scoring tool 160 again flows into the removable section 40, thus placing the metal in the removable section further under compression. During this operation, the one or more raised portions extending about surface 154 also cooperate with V-shaped scoring tool 160 to produce certain areas of minimum residual R1 (FIG. 13) which are slightly less than the residual of the remainder of the weakened line. Thus, the major portion of the residual defined by scoring tool 160 has a thickness R and each raised portion will produce a small area of minimum residual thickness R1.

It has been found desirable to have two diametrically opposed areas of reduced residual R1 each of which has a circumferential dimension of approximately one-quarter inch. Also, the residual R preferably has a thickness of approximately 0.0030 inches and the residual R1 has a thickness of approximately 0.0020 inches.

The areas of reduced residual R1 have two distinct advantages in producing an acceptable removable section for a container particularly of the type that has carbonated beverages under pressure packaged therein. The primary advantage is that it reduces the amount of pressure required to initiate rupture of the first portion of the residual or weakened line 42 and this is particularly true when the tab is configured to localize the forces exerted during initial rupture of the residual. Secondly and probably of even greater importance is the fact that the location of the initial rupture of the score can be predetermined and this initial rupture of the score at a localized area provides a vent for relieving the pressure of the contents in the container. This localized area can be positioned with respect to the tab to ensure that the product does not squirt beyond the tab, as will be explained later.

Figure 12:
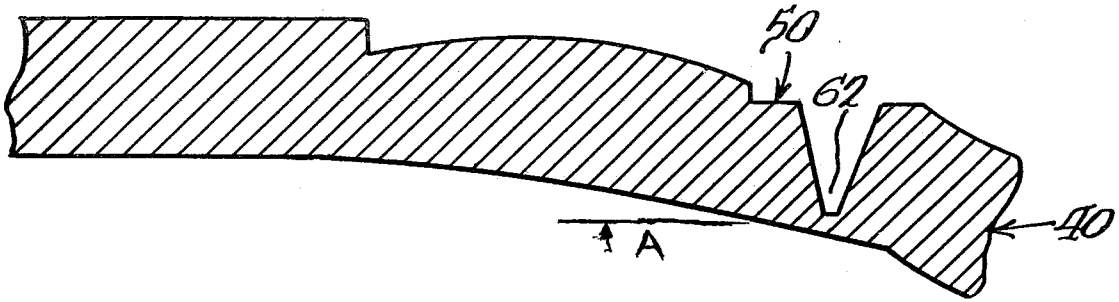
FIG. 12 is an enlarged fragmentary sectional view showing the final configuration of the weakened area defining the removable section.

The final configuration of the removable section (before attachment of the tab thereto) is illustrated in FIG. 11 and the cross-sectional configuration of the area surrounding removable section 40 is illustrated in FIG. 12.

It has been determined that after the die elements 150 and 152 are separated, the compression of the metal in removable section 40, as well as the area between inner and outer coins 50 and 60, will result in a redistribution of the metal adjacent the score 62. It is believed that the compressive forces developed in the metal will actually result in having the outer wall of the V-shaped score 62 reoriented so that the angle between this wall and a vertical reference plane is actually reduced. In addition, it has been determined that the residual R will also be transformed and the lower flat wall portion of the V-shaped score will actually be inclined somewhat so that the metal from the removable section or disc will actually flow under the metal directly outside of score 62. Actual tests have determined that this redistribution of the metal in the residual R will produce a certain amount of overlap of the metal between wall portion 34 and removable section 40. This redistribution of the metal results in a locking feature between the exterior of the removable section or disc 40 and the remainder of wall portion 34.

These tests have shown that the panel formed in the manner described above has increased resistance to "buckle", which means the pressure that the end must resist before the dish-shaped removable section will begin to invert causing an initial point of failure of the residual or weakened line.

It is also believed that the "drape angle" of the area between inner and outer coins 50 and 60 increases the "buckle" resistance and, at the same time, reduces the forces required to rupture weakened line 42. While the "drape angle" has been found to be an important factor in determining the force required to rupture weakened line, the exact parameters of this angle have not been fully explored. Applicant has determined that the optimum "drape angle" in a sample end actually tested was 8 degrees and that this "drape angle" should in all instances be a small acute angle probably on the order of less than 15 degrees. If the angle becomes too large it has been determined that score line 62 cannot be severed with finger pressure that is normally applied to these ends. While this phenomenon is not completely understood, it is assumed that the larger angles inhibit the flow of metal from disc 40 under the periphery of the remainder of the panel and, in fact, the metal probably flows over the residual of score 62 to lock the removable section and thereby prevent downward movement of the disc.

The sequence of steps in forming the weakened line have been found to be important. It has been determined that the required force to sever score line 62 is less if the outer coin and the "drape angle" are formed before the score line is produced rather than after the score line. It should also be mentioned that forming score line 62 in the inner coined area 50 reduces the forces required for opening the end. This is because the work hardened material in coined area 50 and producing score line 62 results in making the metal in residual R and R1 more brittle and the residual metal will, therefore, crack rather than tear as is normal when the material is not coined before the score line is produced.

It should be pointed out that the steps of deforming the panel do not show the formation of arcuate reinforcing bead 72 and circular depression 74. These could be formed with reinforcing members 64 or when the lettering shown in FIG. 1 is formed in the metal. Also, in some instances it may be desirable to produce members 64 in two separate steps, i.e., first form primary beads 66 and then form secondary beads 68. The step of deforming blister 80 is rivet 48 has also not been shown since this is conventional in the art.

The details of the removal means or tab 46 will now be described in conjunction with FIGS. 1 through 4. Tab or opening means 46 consists of a substantially circular metal body which has a tongue portion 202 severed from the center thereof through a generally U-shaped slit 203 and tongue 202 remains integral with the tab body adjacent the periphery thereof. Tongue or connecting member 202 has an opening 204 (FIG. 3) which receives blister 80 that is subsequently deformed to form rivet 48 which defines a permanent connection between tab 46 and removable portion 40. Tongue 202 is substantially flat in the area surrounding the rivet 48 and has an upwardly directed inclined wall 206 which extends upwardly a sufficient distance to produce a flat portion 208 that is located approximately at the level of the upper surface of the periphery of tab 46. Tongue 202 then has a downwardly directed trough or bead 209 defined by wall portions 210 and 212. The lower surface of the downwardly directed bead 209 has a projection 214 extending downwardly and this projection is aligned with an area of reduced residual R1 of score line 62, for a purpose that will be described later.

Tab 46 also has a downwardly directed peripheral bead 220 extending the entire circumference of the tab and has end portions which terminate adjacent opposite edges of tongue 202 adjacent the integral connection thereof and bead 220 conforms generally to the configuration of bead 209 so as to define a continuation thereof. Circumscribing bead 220 is positioned so that the lower edge thereof is in direct alignment with the inner edge of weakened line 42, for a purpose that will be described later.

Tab 46 also has an upwardly directed bead 224 which is again circular in plan view and terminates at opposite ends on opposite sides of tongue 202. As shown in FIG. 3, the opposite ends of bead 224 have enlarged portions 226 that extend above the remainder of bead 224. The periphery of the body of tab 46 has a generally flat wall portion 228 located outside of bead 220 and a downwardly directed peripheral reinforcing edge 229.

In operation, the severing of weakened line 42 occurs through application of localized pressure at predetermined points with respect to the score line to insure that the initial rupture occurs at a predetermined location and the propagation of the rupture continues throughout 360 degrees of the score line. In this connection, the initial rupture and propagation of the initial rupture are accomplished by placing the thumb over the localized areas 208 and 226 and producing a downward force thereon. Since the severed tongue portion 202 is small when compared to the remainder of the tab, a greater resultant force is placed on portion 208 and tends to deflect the tongue portion slightly downwardly. This deflection of tongue 202 results of applying a localized force through projection 214 to an area of minimal residual R1 and results in an initial rupture of the score line. The continuation or propagation of the rupture results from the initial downward pressure on enlarged circular portions 226 so that the score line tends to be severed on both sides of the initial rupture and continues all the way around until the entire score line is severed. This can readily be accomplished by producing a downward force initially on the portions 208 and 226 and then turning the thumb slightly so that pressure is applied through the remainder of bead or raised portion 224. After the entire weakened line 42 has been severed, the removable portion or slug 40 will expand slightly because the material therein is under compression until the score line is severed, so that the diameter of the slug 40 is slightly greater than the diameter of the opening 44.

The next step in the opening process is to slide tab 46 and removable portion to the position illustrated in FIG. 4. During this sliding movement, the inclined upper surface of the inclined area directly outside weakened line 42 will act as a ramp for the lower edge of tab 46. In this position, opening 44 is substantially completely exposed for removal of the contents. It should be noted that in the final or stored position, removable portion 40 and tongue 202 are located on one side of panel portion 34 while tab 46 is located on the opposite side. In this stored position, rivet 48 is received into recess 78 so that the tab 46 slug means 40 are locked in a stored position.

The tab or removal means 46 thus performs several important functions in conjunction with the removable means. The primary function of removal means or tab 46 is to sever weakened line 42. Another important function of the tab is to prevent the removable section from dropping into the contents of the container after being severed from the wall portion. The tab also acts as a cover for the area of the residual which is first severed to vent the container and cooperates with the removable section or disc to hold the disc on the wall portion or closure in a stored condition where opening 44 is exposed.

It has been determined that forming the weakened line following the steps as sequentially described above produces an end that is capable of withstanding more than 90 PSIG without "buckling" and that the weakened line can readily be ruptured by applying pressure with a thumb on the tab.

What is claimed is:

1. A method of producing a removable section in a flat metal wall portion of a container comprising the steps of coining a substantially circular first area of reduced thickness in at least one surface of said wall portion in a manner to move the displaced metal into said substantially circular area so that the portion inside said first area is substantially dish-shaped in cross section and the metal is in compression, coining a second area of reduced thickness in said one surface around and spaced from said first area to further compress the metal inside said first area, reshaping an annular area between the first and second areas of reduced thickness to move said first area of reduced thickness away from said one surface, and thereafter forming a closed weakened line in said first area of reduced thickness to produce a residual at the base of said weakened line defining said removable section.

2. The method as defined in claim 1, in which said residual has at least one portion of reduced thickness.

3. The method as defined in claim 2, in which said residual has two circumferentially spaced portions of reduced thickness and in which said two portions are of substantially equal thickness.

4. The method as defined in claim 1, the further step of deforming a pair of reinforcing beads extending generally parallel to each other in said flat metal wall portion outside said second circular area of reduced thickness.

5. The method as defined in claim 4, the further step of deforming further arcuate reinforcing bead in said flat metal wall portion adjacent to and outside said second circular area of reduced thickness with said arcuate reinforcing bead located between said pair of reinforcing beads.

6. The method as defined in claim 5, the further step of attaching a tab to said removable section with said tab being located between and the same side of said wall portion as said pair of reinforcing beads, and in which upper edges of pair of reinforcing beads are located above an upper edge of said tab.

* * * * *